US010455860B2

(12) United States Patent
Lin et al.

(10) Patent No.: US 10,455,860 B2
(45) Date of Patent: Oct. 29, 2019

(54) ELECTRONIC CIGARETTE WITH INTEGRAL MOUTHPIECE

(71) Applicant: Guangrong Lin, Shenzhen, Guangdong (CN)

(72) Inventors: Guangrong Lin, Guangdong (CN); Xianbin Zheng, Guangdong (CN)

(73) Assignee: Guangrong Lin, Shenzhen (CN)

( * ) Notice: Subject to any disclaimer, the term of this patent is extended or adjusted under 35 U.S.C. 154(b) by 113 days.

(21) Appl. No.: 15/576,281

(22) PCT Filed: Jan. 29, 2016

(86) PCT No.: PCT/CN2016/072831

§ 371 (c)(1),
(2) Date: Nov. 21, 2017

(87) PCT Pub. No.: WO2016/188141

PCT Pub. Date: Dec. 1, 2016

(65) Prior Publication Data

US 2018/0140005 A1 May 24, 2018

(30) Foreign Application Priority Data

May 22, 2015 (CN) ..... 2015 1 0267001

(51) Int. Cl.
*A24F 7/00* (2006.01)
*A24F 47/00* (2006.01)
*H05B 3/44* (2006.01)

(52) U.S. Cl.
CPC ..... *A24F 7/00* (2013.01); *A24F 47/00* (2013.01); *A24F 47/008* (2013.01); *H05B 3/44* (2013.01)

(58) Field of Classification Search
CPC ..... A24F 47/00
(Continued)

(56) References Cited

U.S. PATENT DOCUMENTS

2013/0192615 A1* 8/2013 Tucker ..... H01C 17/00 131/328
2015/0216234 A1* 8/2015 Chung ..... A24F 47/008 131/329

FOREIGN PATENT DOCUMENTS

CN 103892467 A 7/2014
CN 104010538 A 8/2014
(Continued)

OTHER PUBLICATIONS

International Search Report of PCT Patent Application No. PCT/CN2016/072831 dated Feb. 29, 2016.
(Continued)

*Primary Examiner* — Phuong K Dinh

(57) ABSTRACT

An electronic cigarette with an integral mouthpiece, comprising a vaporization assembly (1) and a battery module (2) connected mutually. The vaporization assembly (1) comprises a mouthpiece (11) with an opening, a vaporization tube (12), an outer ornamental sleeve (13), a connector (14) and a vaporizer (15); wherein the mouthpiece (11) is integrated with the vaporization tube (12), and the vaporization tube (12) and the connector (14) are telescoped within the outer ornamental sleeve (13); the vaporizer (15) is telescoped into the vaporization tube (12) in a detachable manner. The connector (14) is located at one end of the outer ornamental sleeve (13) and connected to the battery module (2) in a detachable manner; an airflow sealer (16) is provided between the integral inner wall of the mouthpiece (11) and the vaporization tube (12) and the outer wall or the periphery of the end portion of the vaporizer (15).

14 Claims, 6 Drawing Sheets

(58) Field of Classification Search
USPC ..... 131/328–329
See application file for complete search history.

(56) References Cited

FOREIGN PATENT DOCUMENTS

| | | | |
|---|---|---|---|
| CN | 204091012 | U | 1/2015 |
| CN | 204682532 | U | 10/2015 |
| WO | 2014071625 | A1 | 5/2014 |
| WO | 2014153781 | A1 | 10/2014 |

OTHER PUBLICATIONS

1st Office Action of counterpart Chinese Patent Application No. 201510267001.7 dated Feb. 3, 2017.
2nd Office Action of counterpart Chinese Patent Application No. 201510267001.7 dated Sep. 26, 2017.

* cited by examiner

ELECTRONIC CIGARETTE WITH INTEGRAL MOUTHPIECE

FIELD OF THE INVENTION

The present invention relates to the field of electronic cigarettes, particularly to an electronic cigarette with an integral mouthpiece.

BACKGROUND OF THE INVENTION

Electronic cigarettes progressively substitute tobacco and become widely accepted because they do not contain nicotine like tobacco which is harmful to human health.

Mouthpieces of existing electronic cigarettes are normally connected to the vaporization tubes/poles through threaded connection or snap joints, and they are generally made from non-metal materials such as plastics in order to provide pleasant experience to users. However, the threaded connection and snap joints are prone to become abraded or loose in practice, and it will cause the mouth piece to become loose or to fall off from the cigarette body. Consequently, the looseness of the mouthpiece may lead to deterioration of the airtightness of the vapor flow passage, which may affect the use of the electronic cigarette due to air leakage. Besides, there will be a lack of air indrawn for atomization because of the poor airtightness, as a result, the e-liquid may spill to the mouthpiece due to over saturation of the e-liquid in the vaporizer, destroying the user experience. In addition, the mouthpiece fallen off may be ingested by children accidentally, which may pose a great threat to their lives.

SUMMARY OF THE INVENTION

In order to eliminate the drawbacks of the prior art, an electronic cigarette with an integral mouthpiece is provided by this invention. The mouthpiece of the electronic cigarette is integrated with the vaporization tube rather than being connected thereto through threaded connection or snap joints, avoiding the drawbacks caused by the looseness and falloff of the mouthpiece.

The technical solution of the present invention is as follows: an electronic cigarette with an integral mouthpiece, comprising a vaporization assembly and a battery module connected mutually, the vaporization assembly comprises a mouthpiece with an opening, a vaporization tube, an outer ornamental sleeve, a connector and a vaporizer; wherein the mouthpiece is integrated with the vaporization tube, and the vaporization tube and the connector are telescoped within the outer ornamental sleeve. The vaporizer passes through the connector and is telescoped into the vaporization tube in a detachable manner. The connector is located at one end of the outer ornamental sleeve and connected to the battery module in a detachable manner. An airflow sealer is provided between an integral inner wall of the mouthpiece and the vaporization tube and an outer wall or a periphery of the end portion of the vaporizer.

Preferably, the airflow sealer is provided at an end portion of the mouthpiece close to the vaporization tube and located between the inner wall of the mouthpiece and the end portion of the vaporizer, and a through hole is provided in the center of the airflow sealer to serve as a part of the vapor airflow passage.

Preferably, the inner wall of the mouthpiece has an inward-curved flaring shape at the end adjacent to the vaporization tube and the airflow sealer has a similar flaring shape so as to fit the inner wall of the mouthpiece closely.

Preferably, the airflow sealer has a cylinder inner part, a conical outer part, and a circular groove provided between the inner part and the outer part; an inward protrusive tube is provided on the inner wall of the mouthpiece and the circular groove is fitted onto the protrusive tube.

Preferably, the airflow sealer is a sealing ring located between the outer wall of the vaporizer and the inner wall of the vaporization tube.

Preferably, the airflow sealer is located in a sealing groove provided on the outer wall of the vaporizer.

Preferably, an intermediate section of the outer wall of the mouthpiece has an inward-curved flaring shape.

Preferably, the opening of the mouthpiece has an e-liquid collecting groove provided at an exit end thereof.

Preferably, the mouthpiece and the vaporization tube are integrally molded with transparent plastic materials.

Preferably, a long and narrow observing window is provided on the outer ornamental sleeve.

Mouthpieces and vaporization tube of existing electronic cigarettes are generally made from plastics and the threaded connection and snap joints between them are prone to become abraded or loose in practice, it will cause the mouth piece to become loose or to fall off from the cigarette body. The looseness of the mouthpiece may consequently lead to the deterioration of the airtightness of the vapor flow passage, which may affect the use of the electronic cigarette due to air leakage. Besides, there are not enough air indrawn for atomization because of the poor airtightness, as a result, the e-liquid may spill to the mouthpiece due to over saturation of the e-liquid in the atomizer, impacting the user experience. In addition, the mouthpiece fallen off may be ingested by children accidentally. These aforementioned drawbacks can be avoided by integrating the mouthpiece and the vaporization tube together according to the present invention.

DETAILED DESCRIPTION OF PREFERRED EMBODIMENTS

Detailed description of the present invention will be given hereinafter with reference to the drawings.

FIGS. 1-5 show the first embodiment of the present invention.

Figure 1:
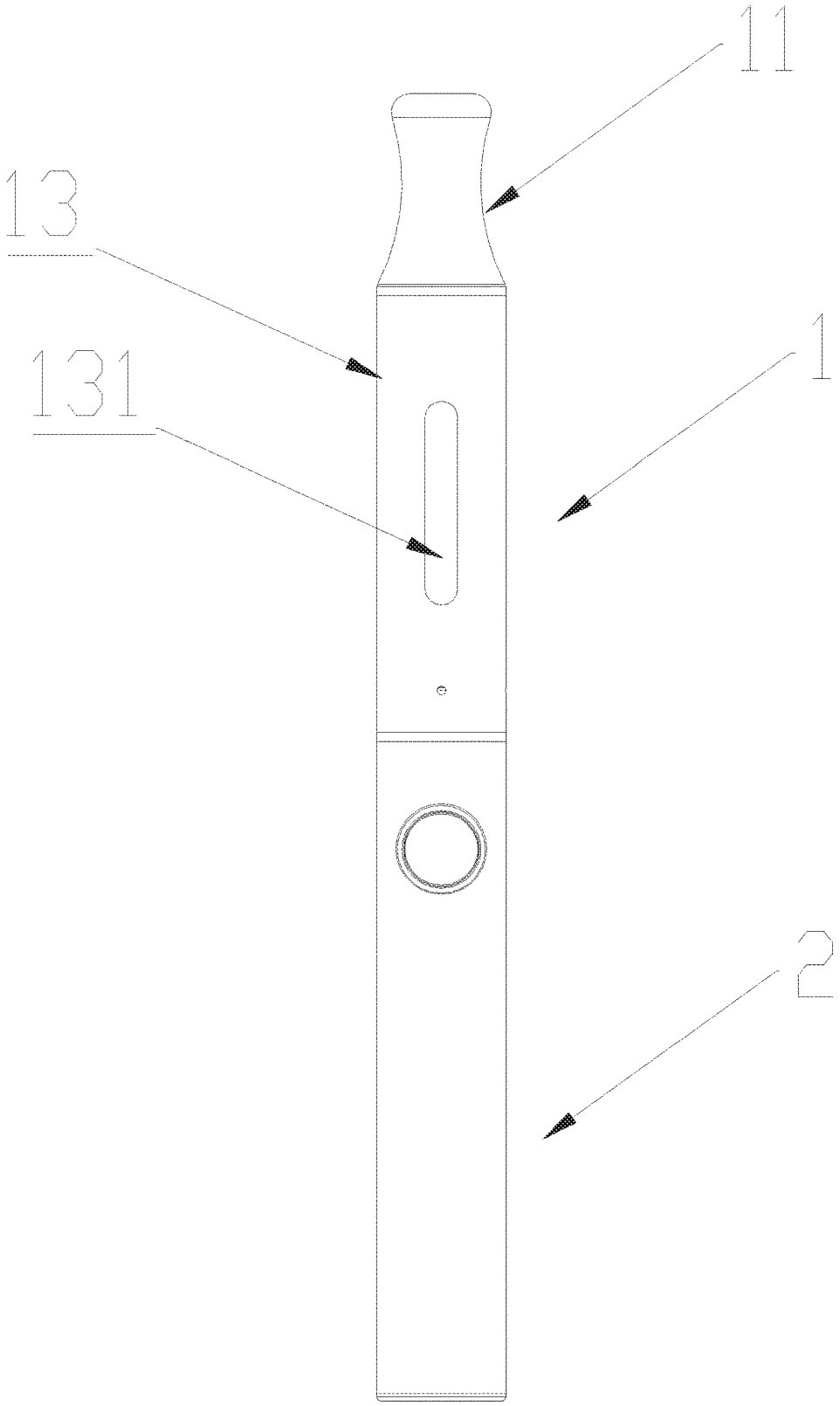
FIG. 1 is a front view of the cigarette with an integral mouthpiece according to the present invention.

As illustrated in FIG. 1, the electronic cigarette with an integral mouthpiece according to the present invention comprise a vaporization assembly 1 and a battery module 2, the vaporization assembly 1 and the battery module 2 are respectively provided with one of a pair of connectors matching with each other. The connectors can be connected via threaded connection, snap joints or rotatable snap joint. The vaporization assembly 1 is connected with the battery module 2 via threads in the first embodiment of the present invention.

Figure 2:
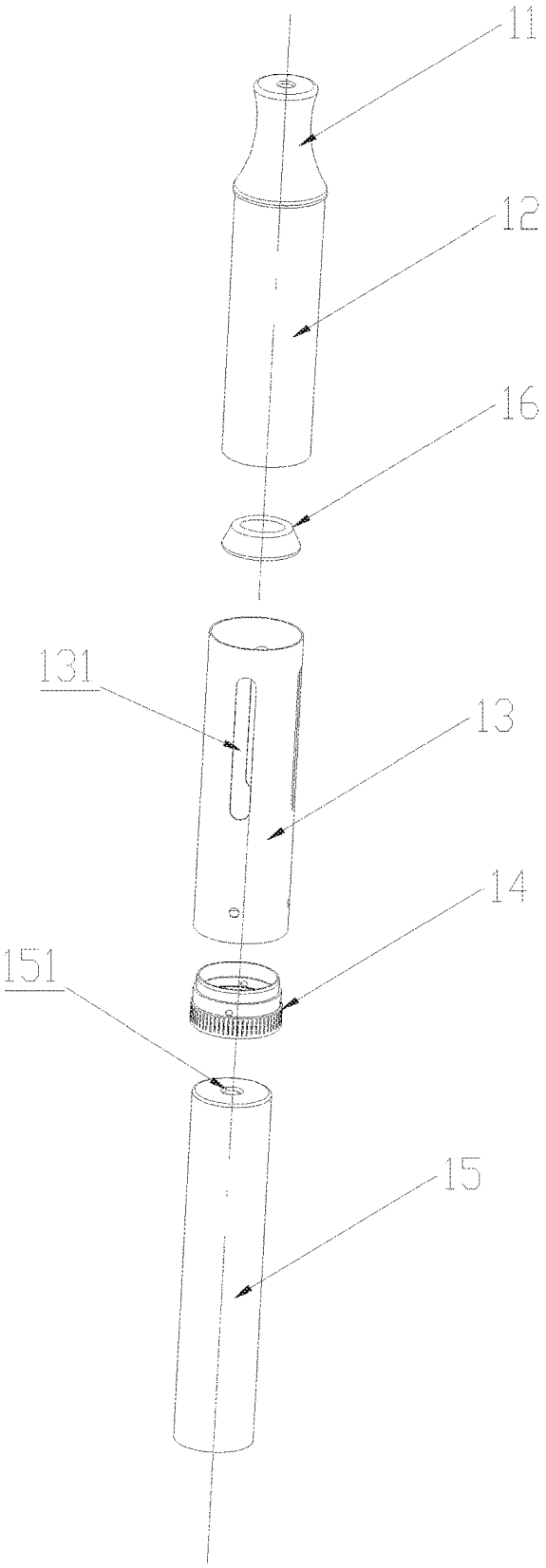
FIG. 2 is an exploded view of the vaporization assembly of the first embodiment according to the present invention.

As shown in FIG. 2, the vaporization assembly 1 comprises a mouthpiece 11, a vaporization tube 12, an outer ornamental sleeve 13, a connector 14 and a vaporizer 15. The intermediate section of the outer wall of the mouthpiece 11 has an inward-curved smooth flaring shape, in this manner, the mouthpiece looks more artistic and fits human lips better, enhancing the user experience.

Figure 3:
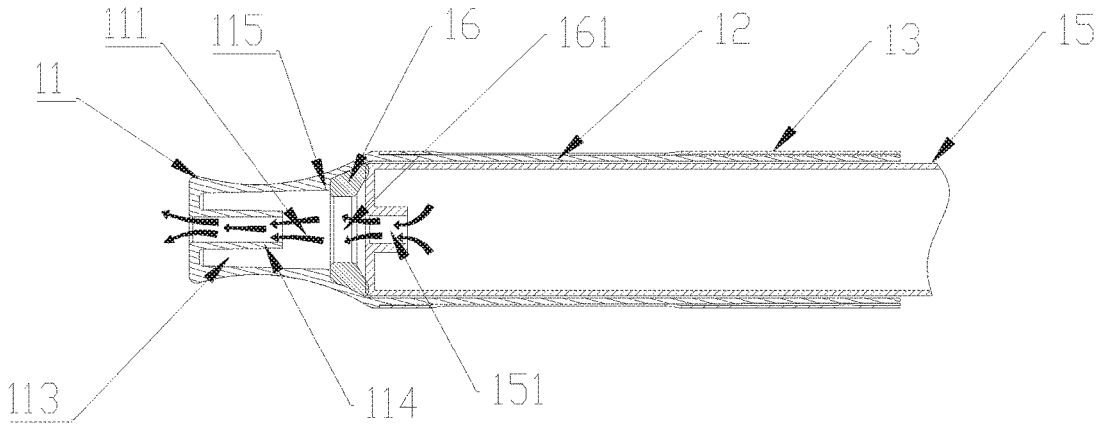
FIG. 3 is a sectional view along the central axis of the vaporization assembly of the first embodiment according to the present invention.

As shown in FIG. 3, the opening 111 of the mouthpiece 11 has an e-liquid collecting groove 113 at the exit thereof. Particularly, a tubular piece 114 is provided at the exit of the mouthpiece 11, and the annular groove between the tubular piece 114 and the inner wall of the mouthpiece 11 is the e-liquid collecting groove 113. In practice, the e-liquid cannot be fully vaporized due to the oversupply thereof, as a result, some e-liquid is converted into small droplets and carried out by vapors. If these small droplets are inhaled by users, their experience on electronic cigarettes will be impacted adversely. By providing the e-liquid collecting groove 113 at the exit, the flow speed of vapor slows down and the small droplets which are not vaporized congeal on the inner wall of the mouthpiece and then converge in the e-liquid collecting groove 113.

As shown in FIG. 2, the mouthpiece 11 and the vaporization tube 12 are integrally molded with an identical material, which avoid the shortcomings of discrete mouthpiece 11 and vaporization tube 12, for instance, the loose of plastic threads or snap joints may cause the leak of air or e-liquid, even falloff of the mouthpiece. In the present embodiment, the mouthpiece 11 and the vaporization tube 12 are integrally molded with transparent plastic materials. Besides, a long and narrow observing window 131 is provided on the outer ornamental sleeve 13 so that the user, without dismounting the vaporizer 15, can observe the quantity of the e-liquid remainder therein.

As shown in FIG. 2, the vaporization tube 12 and the connector 14 are successively telescoped within the outer ornamental sleeve 13. The mouthpiece 11 extends out from an end of the outer ornamental sleeve 13 while the connector 14 is located in the other end thereof. The vaporizer 15 is a cylinder and it can pass through the connector 14 and is telescoped into the vaporization tube 12 in a detachable manner (since the vaporizer 15 is well developed, description of its structure is omitted in the present embodiment). The connector 14 is connected to the battery module 12 via threads in a detachable manner.

As shown in FIGS. 2-3, a vapor flow passage 151 is provided in the interior and the end portion of the vaporizer 15 to allow vapor to flow out. In order to ensure the airtightness of the vapor flow passage 151 of the vaporizer 15 so that the user can suck out vapor from the cigarette via the mouthpiece 11, an airflow sealer 16 is provided between the integral inner wall of the mouthpiece 11 and the vaporization tube 12 and the outer wall or the periphery of the end portion of the vaporizer 15. Because the mouthpiece 11 and the vaporization tube 12 are integrally molded, the airflow sealer 16 needs to be telescoped from the other end portion of the vaporization tube 12 opposite to the mouthpiece. The successive bold arrows in FIG. 3 indicate the direction in which the vapor flows out.

Figure 4:
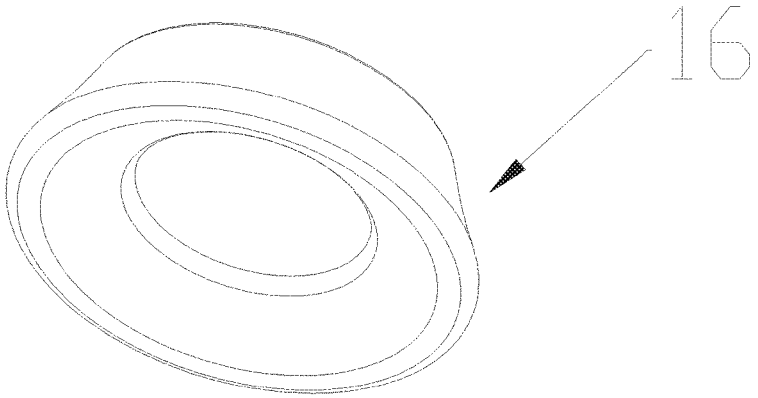
FIG. 4 is a perspective view of the airflow sealer of the first embodiment according to the present invention.
Figure 5:
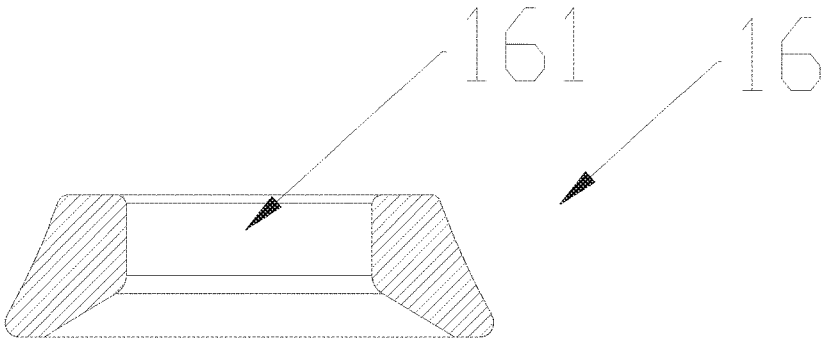
FIG. 5 is a sectional view of the airflow sealer of the first embodiment according to the present invention.
Figure 6:
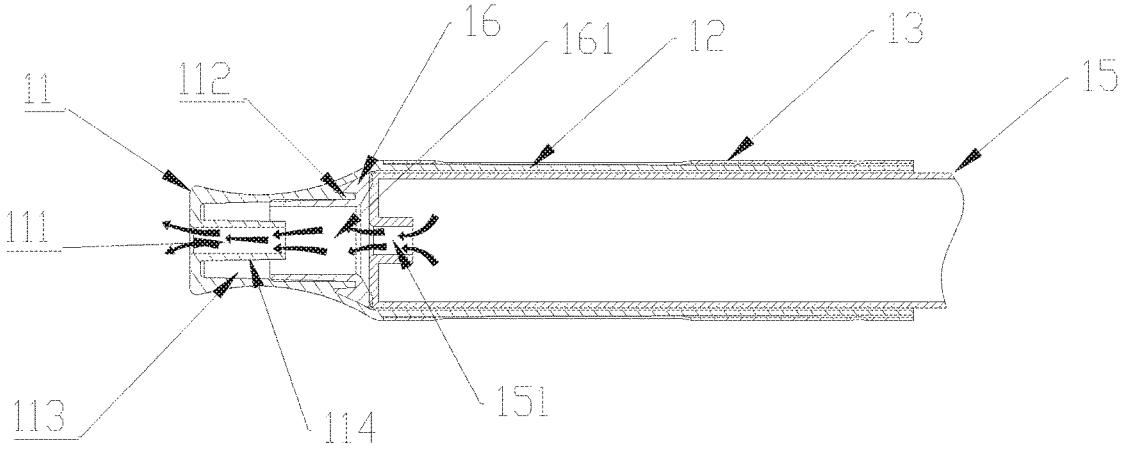
FIG. 6 is a sectional view along the central axis of the vaporization assembly of the second embodiment according to the present invention.
Figure 7:
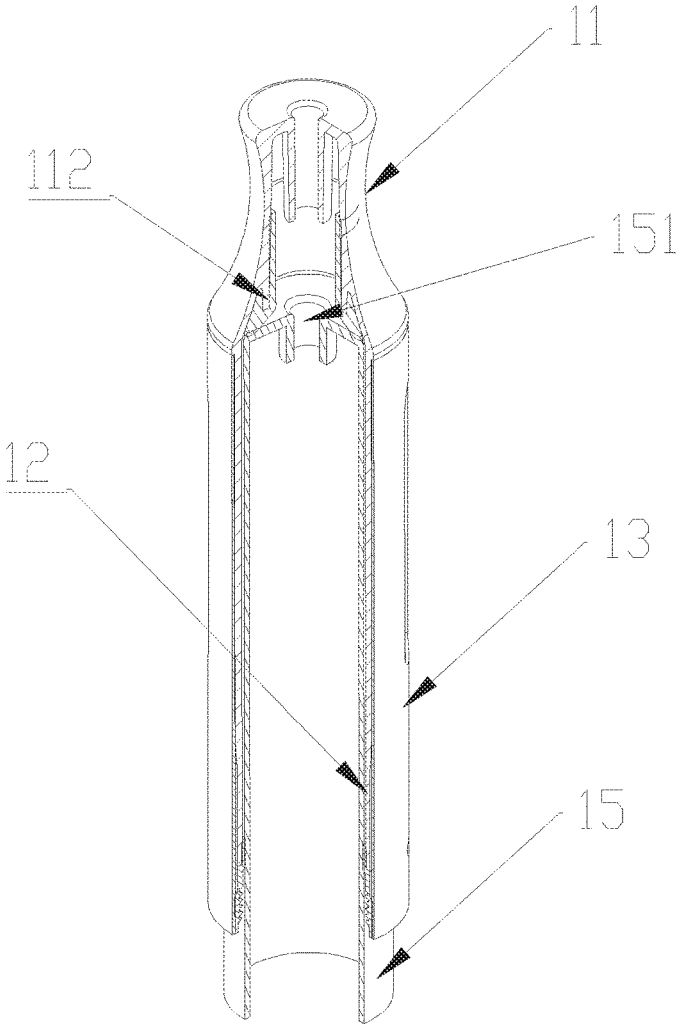
FIG. 7 is a perspective sectional view of the vaporization assembly of the second embodiment according to the present invention.
Figure 8:
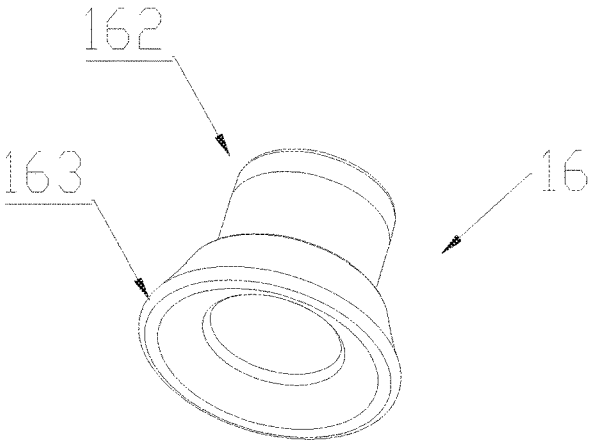
FIG. 8 is a perspective view of the airflow sealer of the second embodiment according to the present invention.
Figure 9:
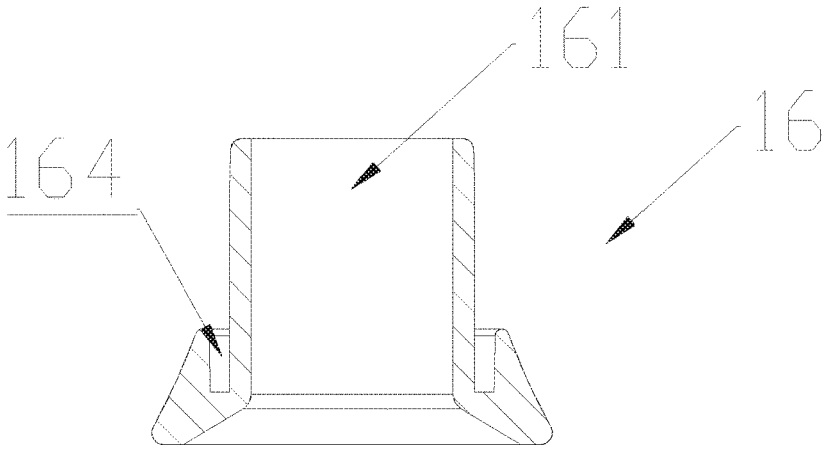
FIG. 9 is a sectional view of the airflow sealer of the second embodiment according to the present invention.
Figure 10:
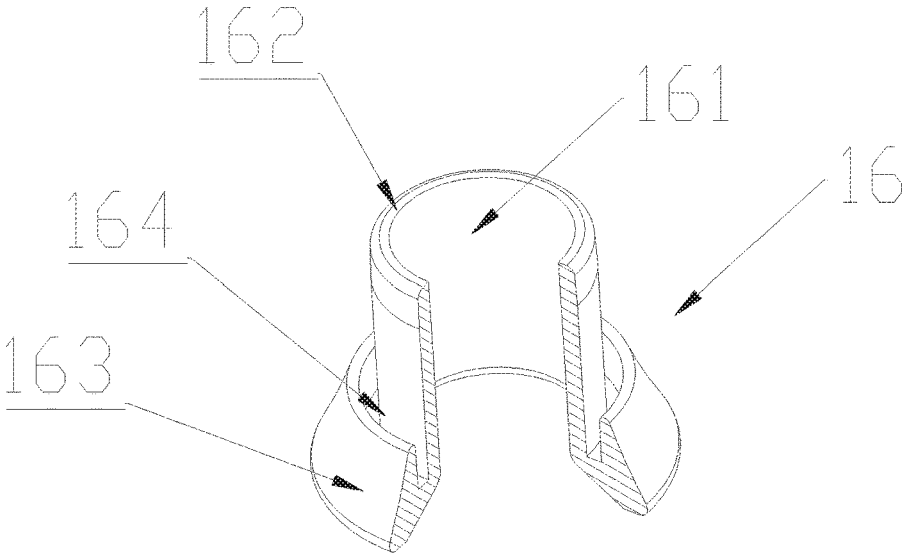
FIG. 10 is a perspective sectional view of the airflow sealer of the second embodiment according to the present invention.

As shown in FIGS. 3, 4 and 5, the airflow sealer 16 is provided at the end portion of the mouthpiece 11 close to the vaporization tube 12 and located between the inner wall of the mouthpiece 11 and the end portion of the vaporizer 15. Besides, a through hole 161 is provided in the center of the airflow sealer 16 to serve as a part of the vapor airflow passage. Particularly, the inner wall of the mouthpiece 11 has a inward-curved flaring shape at the end being adjacent to the vaporization tube 12 (i.e. toward interior of the electronic cigarette and the end portion of the vaporizer), and the outer wall of the airflow sealer 16 has a similar flaring shape so as to be telescoped into the vaporization tube and to fit the inner wall of the mouthpiece 11 closely. The inner wall of the mouthpiece is further provided with a shoulder 115 in order to block and locate the end portion of the airflow sealer 16. The assembly process of the electronic cigarette with an integral mouthpiece is as follows: firstly, the integral mouthpiece 11 and vaporization tube 12, the connector 14 are telescoped in the outer ornamental sleeve 13. And then, the airflow sealer 16 is placed in the vaporization tube 12 with its smaller end inward so that the airflow sealer 16 abuts against the inner wall of the mouthpiece 11 and the shoulder 115. After that, the vaporizer 15 is inserted into the vaporization tube 12 with the end portion having the cartridge inward, as well as into the outer ornamental sleeve 13. Subsequently, the connecting end of the battery module 2 is screwed onto the connector 14, in this manner, the end face of the cartridge of the vaporizer 15 abuts against the airflow sealer 16 and presses it to abut tightly against to the inner wall of the mouthpiece 11 and the shoulder 115 so as to ensure the gap between the outer wall of the vaporizer 15 and the inner wall of the mouthpiece 11 and the vaporization tube 12 is blocked, and to avoid users' failure in sucking vapor caused by the leak of the airflow passage. In addition, while the connecting end of the battery module 2 is screwed onto the connector 14, the other end of the vaporizer 15, i.e. the vaporizing end, can abut against the connecting end of the battery module 2 so as to ensure the vaporizer 15 is electrically connected to the pole of the battery module 2 to supplying power to the heating wires of the vaporizer 15 for heating up and vaporizing the e-liquid.

FIGS. 2, 6-7, 8-10 show the second embodiment of the present invention.

As shown in these figures, the airflow sealer 16 is modified on the basis of the first embodiment in the following way to make the airflow sealer 16 abut against the inner wall of the mouthpiece 11 and get fixed there more tightly: the inner part of the airflow sealer 16 is configured as a cylinder part 162, the outer part is configured as a conical part 163, and a circular groove 164 is provided between them; Meanwhile, an inward protrusive tube 112 is provided on the inner wall of the mouthpiece 11 and the circular groove 164 is fitted onto the protrusive tube 112. In this manner, the airflow sealer 16 gets fixed and protected from over-pressure which may cause dislocation, falloff of the airflow sealer and damage of the airtightness thereof. On the basis of the integral structure of the mouthpiece 11 and vaporization tube 12, the airflow sealer 16 according to the present embodiment can be fixed reliably because of the fit between the protrusive tube 112 and the circular groove 164, whereby good airtightness of the vapor flow passage 151 can be ensured and malfunction such as leak of air or e-liquid can be avoided.

FIGS. 1-5, 11-12 show the third embodiment of the present invention.

Figure 11:
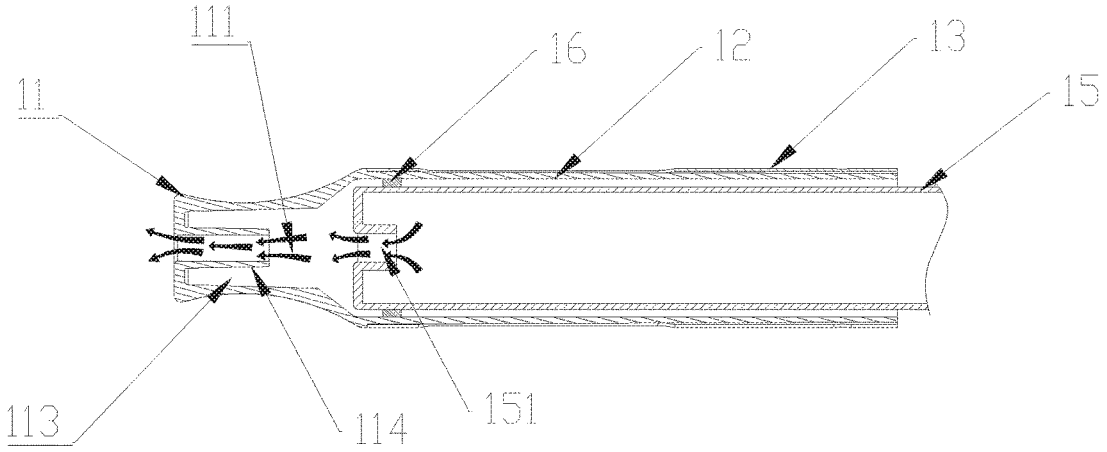
FIG. 11 is a sectional view along the central axis of the vaporization assembly of the third embodiment according to the present invention.
Figure 12:
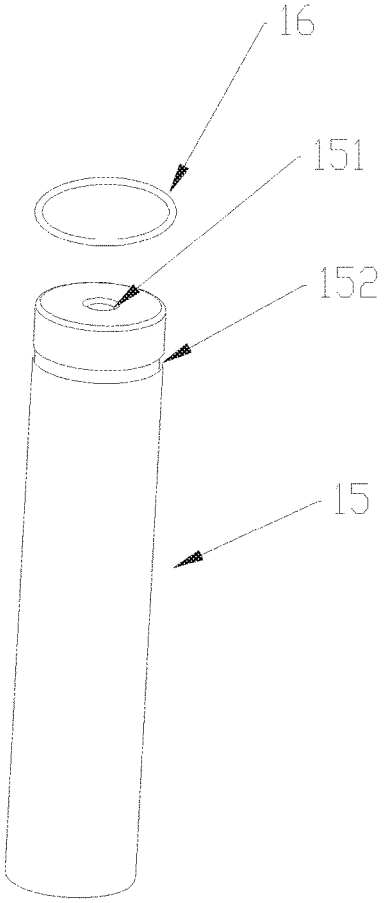
FIG. 12 is an outer view of the vaporizer of the third embodiment according to the present invention.

As shown in FIGS. 11-12, the airflow sealer 16 is modified on the basis of the first embodiment in the following way: the airflow sealer 16 is configures as a sealing ring being located between the outer wall of the vaporizer 15 and the inner wall of the vaporization tube 12. In order to fasten the sealing ring, the outer wall of the vaporizer 15 is provided with a sealing groove 152 in which the sealing ring 16 in located. Similarly, this solution can also ensure the gap between the outer wall of the vaporizer 15 and the inner wall of the vaporization tube 12 is blocked and users' failure in sucking vapor caused by the leak of the airflow passage can be avoided, thereby the same effects can be achieved.

All the above are the preferred embodiments of the present invention, and the invention is intended to cover various modifications and equivalent arrangements included within the scope of the invention.

LIST OF REFERENCE NUMERALS

1 Vaporization assembly
11 Mouthpiece
111 Opening
112 Protrusive tube
113 E-liquid collecting groove
114 Tubular piece
115 Shoulder
12 Vaporization tube
13 Outer ornamental sleeve
14 Connector
15 Vaporizer
151 Vapor flow passage
152 Sealing groove
16 Airflow sealer
161 Through hole
162 Cylinder part
163 Conical part
164 Circular groove
2 Battery module

What is claimed is:

1. An electronic cigarette with an integral mouthpiece, comprising a vaporization assembly and a battery module connected mutually; the vaporization assembly comprises a mouthpiece with an opening, a vaporization tube, an outer ornamental sleeve, a connector and a vaporizer; wherein the mouthpiece is integrated with the vaporization tube, and the vaporization tube and the connector are telescoped within the outer ornamental sleeve; the vaporizer passes through the connector and is telescoped into the vaporization tube in a detachable manner; the connector is located at one end of the outer ornamental sleeve and connected to the battery module in a detachable manner; an airflow sealer is provided between an integral inner wall of the mouthpiece and the vaporization tube and an outer wall or a periphery of an end portion of the vaporizer;

the airflow sealer is provided at an end portion of the mouthpiece close to the vaporization tube and located between the inner wall of the mouthpiece and the end portion of the vaporizer, and a through hole is provided in the center of the airflow sealer to serve as a part of the vapor airflow passage;

wherein the inner wall of the mouthpiece has an inward-curved flaring shape at an end being adjacent to the vaporization tube, and an outer wall of the airflow sealer has a similar flaring shape so as to be telescoped into the vaporization tube and fit the inner wall of the mouthpiece closely.

2. The electronic cigarette with an integral mouthpiece according to claim 1, wherein airflow sealer has a cylinder inner part, a conical outer part, and a circular groove provided therebetween; a protrusive tube is provided on the inner wall of the mouthpiece and the circular groove is fitted onto the protrusive tube.

3. The electronic cigarette with an integral mouthpiece according to claim 1, an intermediate section of the outer wall of the mouthpiece has an inward-curved flaring shape.

4. The electronic cigarette with an integral mouthpiece according to claim 1, wherein the mouthpiece and the vaporization tube are integrally molded with transparent plastic materials.

5. The electronic cigarette with an integral mouthpiece according to claim 4, wherein a long and narrow observing window is provided on the outer ornamental sleeve.

6. An electronic cigarette with an integral mouthpiece, comprising a vaporization assembly and a battery module connected mutually; the vaporization assembly comprises a mouthpiece with an opening, a vaporization tube, an outer ornamental sleeve, a connector and a vaporizer; wherein the mouthpiece is integrated with the vaporization tube, and the vaporization tube and the connector are telescoped within the outer ornamental sleeve; the vaporizer passes through the connector and is telescoped into the vaporization tube in a detachable manner; the connector is located at one end of the outer ornamental sleeve and connected to the battery module in a detachable manner; an airflow sealer is provided between an integral inner wall of the mouthpiece and the vaporization tube and an outer wall or a periphery of an end portion of the vaporizer;

wherein the airflow sealer is a sealing ring being located between the outer wall of the vaporizer and the inner wall of the vaporization tube.

7. The electronic cigarette with an integral mouthpiece according to claim 6, wherein the airflow sealer is located in a sealing groove provided on the outer wall of the vaporizer.

8. The electronic cigarette with an integral mouthpiece according to claim 6, an intermediate section of the outer wall of the mouthpiece has an inward-curved flaring shape.

9. The electronic cigarette with an integral mouthpiece according to claim 6, wherein the mouthpiece and the vaporization tube are integrally molded with transparent plastic materials.

10. The electronic cigarette with an integral mouthpiece according to claim 9, wherein a long and narrow observing window is provided on the outer ornamental sleeve.

11. An electronic cigarette with an integral mouthpiece, comprising a vaporization assembly and a battery module connected mutually; the vaporization assembly comprises a mouthpiece with an opening, a vaporization tube, an outer ornamental sleeve, a connector and a vaporizer; wherein the mouthpiece is integrated with the vaporization tube, and the vaporization tube and the connector are telescoped within the outer ornamental sleeve; the vaporizer passes through the connector and is telescoped into the vaporization tube in a detachable manner; the connector is located at one end of the outer ornamental sleeve and connected to the battery module in a detachable manner; an airflow sealer is provided between an integral inner wall of the mouthpiece and the vaporization tube and an outer wall or a periphery of an end portion of the vaporizer;

wherein the opening of the mouthpiece as an e-liquid collecting groove provided at an exit end thereof.

12. The electronic cigarette with an integral mouthpiece according to claim 11, an intermediate section of the outer wall of the mouthpiece has an inward-curved flaring shape.

13. The electronic cigarette with an integral mouthpiece according to claim 11, wherein the mouthpiece and the vaporization tube are integrally molded with transparent plastic materials.

14. The electronic cigarette with an integral mouthpiece according to claim 13, wherein a long and narrow observing window is provided on the outer ornamental sleeve.

* * * * *